United States Patent [19]

Davison et al.

[11] Patent Number: 4,895,700

[45] Date of Patent: Jan. 23, 1990

[54] LOW GRADE MATERIAL AXLE SHAFT

[75] Inventors: Kent E. Davison, Columbia City; Ervin M. Rickert, Fort Wayne, both of Ind.

[73] Assignee: Dana Corporation, Toledo, Ohio

[21] Appl. No.: 240,629

[22] Filed: Sep. 6, 1988

Related U.S. Application Data

[62] Division of Ser. No. 166,178, Mar. 10, 1988, Pat. No. 4,820,357.

[51] Int. Cl.[4] ..... C22C 38/04; C22C 38/06

[52] U.S. Cl. ..... 420/8; 148/320; 148/332; 148/904; 148/333; 420/87; 464/902

[58] Field of Search ..... 148/320, 332, 904, 333, 148/334, 335, 336; 420/8, 87; 464/179, 902

[56] References Cited

FOREIGN PATENT DOCUMENTS

| | | | |
|---|---|---|---|
| 58-71354 | 4/1983 | Japan | 148/904 |
| 3201204 | 8/1983 | Japan | 148/904 |

*Primary Examiner*—Deborah Yee

*Attorney, Agent, or Firm*—Gifford, Groh, Sheridan, Sprinkle and Dolgorukov

[57] ABSTRACT

A new SAE 1541M alloy steel composition consisting essentially of 0.40–0.48% carbon, 1.35–1.61% maganese, 0.16–0.30% silicon, 0–0.23% chromium and the balance iron and other materials not affecting hardenability of the steel, especially adapted for forming axle shafts in the 1.70-2.05" diameter range to be used as drive axles with an axle load carrying capacity between 30,000 and 44,000 pounds.

5 Claims, No Drawings

LOW GRADE MATERIAL AXLE SHAFT

This is a division of application Ser. No. 166,178, filed Mar. 10, 1988, now U.S. Pat. No. 4,820,357

BACKGROUND OF THE INVENTION

1. Field of the Invention

This invention relates to a new alloy composition, and, more particularly, to a new alloy composition and a method of forming drive axle shafts having a minimum diameter of 1.70 inches and a minimum capacity of 30,000 pounds.

2. Description of the Prior Art

One of the most important considerations in selection for formulation of a carbon steel alloy for producing a high strength axle shaft is controlling the hardenability of the alloy. Proper hardenability in turn depends upon having an alloy with the proper carbon content, that is, a high enough carbon content to produce the minimum surface hardness measured on the Rockwell C Scale, $R_c$, and a low enough carbon content to be able to control the hardening process without exceeding maximum desired surface hardness of penetration of hardness into the core of the axle shaft. Hardenability establishes the depth to which a given hardness penetrates, which can also be defined as the depth to which martensite will form under the quenching conditions imposed, that is, at a quenching rate equal to or greater than the critical cooling rate.

Modern day hardenability concepts had their origin around 1930 in the research laboratories of United States Steel Corporation. In 1938 the Jominy Test came into being in the laboratories of General Motors as a means of determining hardenability. The test consists of quenching the end of a one inch round bar and determining the hardness, $R_c$, at 1/16" intervals along the bar starting at the quenched end. Grossman at United States Steel pioneered the calculation of hardenability presenting it in a paper published in the Trans Am. Inst. Mining Met. Engrs., V. 150, 1942, pp. 227-259. Grossmann postulated that hardenability can be based on a bar of ideal diameter, DI, defined as a diameter in inches of a bar that shows no unhardened core in an ideal quenching condition, or further defining it to produce a 50% martensite structure at the center of the bar. The calculation of DI is presented in many metallurgical texts, for example, in "Modern Metallurgy for Engineers" by Frank T. Sisco, second edition, Pitman Publishing Company, New York, 1948 or in the text "The Hardenability of Steels—Concepts, Metallurgical Influences and Industrial Applications" by Clarence A. Siebert, Douglas V. Doane and Dale H. Breen published by the American Society of Metals, Metals Park, Ohio, 1977.

Basically, the critical diameter in inches, DI, is calculated by multiplying together the multiplying factor, MF, for all the elements found in a particular steel either as residuals or purposly added to the steel. For example, a SAE/AISI 1040 carbon steel, using the Grossmann data would have the following multiplying factors for a typical percentage as follows:

Carbon 0.39% MF,=0.23; manganese 0.68%, MF=3.27; silicon 0.11%, MF=1.08; nickel 0.12%, MF=1.05, chromium 0.04%, MF=1.09; molybdenum, 0.02%, MF=1.06. The ideal diameter is then calculated as $DI=0.23\times3.27\times1.08\times1.05\times1.09\times1.06$ equals 0.98 inches. This would mean that an ideal diameter with a perfectly quenched steel would be 0.98 inches; thus, to insure proper hardenability, the maximum diameter of this shaft would be something less than 0.98 inches probably of the order of ¾".

By utilizing the DI calculations, it can be determined what can be the maximum diameter of the shaft of a particular composition that will have a desirable hardenability profile with 50% Martensite at the center of the core.

It is well established that high manganese carbon steel compositions provide satisfactory hardenability because the manganese allows the carbon to penetrate into the core in solution with the iron to produce the desired martensite as quenched. A SAE/AISI 1541 medium carbon steel having 0.36-0.44% C and 1.35-1.65% Mn will have adequate hardenability for axle shafts with a maximum diameter of less than 1.7 inches to produce a load carrying capacity of less than 30,000 pounds. Axle shafts with a body diameter greater than 1.7 inches for axle load carrying capacities of 30,000, 34,000, 38,000 or 44,000 pounds, cannot be produced with a 1541 steel because the manganese cannot produce a desirably hardness profile into the core of the shaft resulting in at least 50% martensite at the center. A satisfactory solution to this problem is obtained by the use of trace percents of boron in the SAE 1541 steel denoting the steel as SAE 15B41. Such boron percentages, are typically in the range between 0.0005-0.003% boron.

With the use of boron in the steel to produce the proper hardenability profile, the risk of retaining residual stresses after forging the usual spline at one end and flange at the other end of the axle shaft is present. This can greatly reduce the fatigue life of the shaft, producing premature failure by stress cracking. This is true because the boron will precipitate out into the grain boundaries as boron nitride to product brittleness. To counteract this the boron nitride is driven out of the grain boundaries when the axle shafts are normalized by heating to above the transformation temperature and air cooling. This is a time consuming and very expensive process.

SUMMARY OF THE INVENTION

The present invention is directed to the formulation of an alloy which has good hardenability so that axle shafts of 1.70-2.05 inch body diameters can be formed as drive axles with a load carrying capacity from 30,000 to 44,000 pounds. With an alloy steel consisting essentially of 0.40-0.48% carbon, 1.35-1.61% manganese, 0.16-0.30% silicon, 0-0.23% chromium and the balance iron and other materials not affecting the hardenability of the steel, the axles shaft may be formed by forging the ends of a shaft to form a spline at one end thereof and a flange at the other end thereof, machining the ends to final configuration and dimension, and induction hardening the shaft without any intervening annealing or normalizing after forging.

The alloy steel should contain between 0.025 and 0.05% aluminum to promote a grain size of the steel of ASTM 5 to 8 further assuring the proper hardenability.

The alloy typically will contain 0-0.15% copper, 0.-0.20% nickel, 0-0.15% molybdenum, 0.02-0.045% sulfur and 0.035% maximum phosphorus.

The axle shaft should have a critical diameter between 2.1 and 2.6 inches.

The axle shaft should also have a maximum hardness at its center of $R_c$ 35 with a surface hardness after tempering of $R_c$ 52 to $R_c$ 59 and a maximum hardness of $R_c$ 40 at a distance of 0.470 inches measured from the surface. This hardness profile should exist when the foregoing composition and critical diameter criteria have been met.

DETAILED DESCRIPTION OF THE PREFERRED EMBODIMENTS OF THE INVENTION

In the search for high strength steel alloys having good hardenability, small changes in the chemistry can have a dramatic effect on the ability of the alloy to meet the design criteria, and the method of forming the product, such as an axle shaft, can be substantially changed. An example of such a change in chemistry and the resulting change in product preformance and method of forming is envolved in the manyfacture of axle shafts. In the forming of automotive axles, primarily for passanger cars and light trucks where the body diameter does not exceed 1.70", the axle shaft can be manufactured with a 1541 alloy steel which will meet hardenability specifications without normalizing or annealing. With axle shafts of 1.70–2.05 inch body diameters used in axles with axle load carrying ratings from 30,000 to 44,000 pounds, if a 1541 alloy is used, there will be insufficient hardenability or depth of hardening and the axle shaft will have an unsatisfactory life expectancy. The standard axle shafts in this range of body diameters and capacities have heretofore been manufactured utilizing a 15B41 steel which has trace amounts of boron in the steel to increase the depth of hardening to produce the required strengths with adequate fatigue life.

The chemical composition for SAE/AISI 1541 is as follows:

| ELEMENT | ANALYSIS RANGE MAXIMUM % BY WEIGHT |
|---|---|
| Carbon | .36–.44 |
| Manganese | 1.35–1.65 |
| Silicon | .15–.35 |
| Sulfur | .050 max. |
| Phosphorus | .040 max. |

The analysis for the boron added steel 15B41 is the same as presented in the above table with the addition of 0.0005–0.003 percent boron. With the 15B41 high manganese carbon steel with boron added, axle shafts in industry standard strengths can be produced having adequate fatigue life with the following diameters:

| AXLE RATING POUNDS | BODY DIAMETER INCHES |
|---|---|
| 30,000 | 1.72 |
| 34,000 | 1.84 |
| 38,000 | 1.91 |
| 44,000 | 2.05 |

While the 15B41 steel composition provides proper hardenability at the required strength levels, the method of manufacturing the axle shaft becomes more complex.

Typically the axle shaft is manufactured from bar stock having the desired body diameter. After cutting the rod to the desired axle shaft length, the ends of the shaft are forged to produce a spline at one end and a flange at the other end. The configuration and final dimensions of the spline and flange are determined by the manufacturer or tailored to specification for the original equipment manufacturer or for the replacement parts market. The spline and flange are machined to this final dimension after the forging operation. The hardening of the shaft is accomplished by heating it after machining to above the upper critical temperature and water quenching. Preferably this is accomplished by induction heating either in a one-shot process where the axle is rotated between centers and the induction coil is stationary or by the induction scanning process where the axle shaft is rotated and the induction coil is moved. A rapid water quench produces the desired hardness gradient. The shaft is finally tempered in a continuous tempering furnace to relieve residual stresses, which can reduce the hardness values by a couple points on the Rockwell C scale.

With the use of 1541 for the smaller diameter axle shafts, the foregoing method of forming the axle shaft is followed without the use of any intermediate heat treating between the forging and the machining steps. With the use of 15B41, the boron introduces grain boundary stresses. To reduce these stresses, it is necessary to anneal or normalize the axle shaft after the forging operation and prior to the machining and hardening steps. An annealing or normalizing process is a time consuming and expensive procedure, thus increasing the cost of the axle shaft.

Other steel alloys which meet the strength and hardenability requirements such as 50B50 are more expensive and also require normalizing after forging.

In working with various alloy compositions and evaluating the hardenability by performing a hardness profile across the diameter much like the Jominy lengthwise profile, it has been found that a fully adequate hardenability profile will prevail if the shaft has a minimum yield strength of 110,000 pounds per square inch. This will also assure a more than adequate fatigue life. Knowing that chromium, like manganese, can extend the hardness penetration into the core of a shaft, formulations with different manganese and chromium compositions were tested. Too high of a chromium content also tends to produce a steel with too much harenability. Also if the manganese is on the high side when the carbon is also on the high side, there is a tendency to harden to too great of a degree at the core, causing reduced fatigue life. Starting with the aforementioned composition of a 1541 steel, and partially ignoring the general teaching that increasing both the manganese and the carbon content will increase the hardness penetration or hardenability, it was found that shifting the carbon range slightly higher and lowering to a small degree the higher manganse limit coupled with a judicious addition of a small percent of chromium, a new steel alloy could be formulated which will provide a more than adequate case depth. The chemical composition for this SAE/AISI 1541M steel alloy is as follows:

| ELEMENT | ANALYSIS RANGE OR MAXIMUM PERCENT BY WEIGHT |
|---|---|
| Carbon | .40–.48 |
| Manganese | 1.35–1.61 |
| Chromium | 0–.23 |
| Silicon | .16–.30 |
| Sulphur | .020–.045 |
| Phosphorus | .35 max. |
| Molybdeum | 0–.15 |
| Nickel | 0–.20 |
| Copper | 0–.15 |

The nickel and copper components of the new 1541M alloy steel are residual percentages which are normally found in melts in this country. Likewise the silicon, suplhur and phosphorus contents are those commonly imposed and accepted for standard carbon alloy steel compositions. Aluminum in the range in 0.025–0.05% range can be utilized to assure a fine grain size of ASTM5-8.

It has also been found that if the ideal critical diameter, DI, range is also specified, there is additional assurance that an axle shaft formed by the method which eliminates an annealing or normalizing step after forging, will more than adequately meet the strength and fatigue requirements, and hardness profiles will not have to be taken to assure this. For the actual diameter range of 1.70–2.05 inches, this range is DI=2.1–2.6 inches. The imposition of this ideal diameter range requirement eliminates the rare possibility that all of the elements could be on the minimum side or the maximum side which could produce an inadequate life expectancy.

In calculating the DI, the MF for carbon, manganese, nickel, chromium, molybdeum, copper, and silicon is utilized. The multiplying factor MF for the aluminum would be 1.0 if it is absent or present in the quantity mentioned above to assure a fine grain size range. The multiplying factors for phosphorus and sulphur are not used in this calculation since they cancel each other out in the composition range given, that is, the factor for phosphorus is about 1.03 and the factor for sulphur is about 0.97.

In formulating the critical diameter range of 2.1–2.6 inches, Caterpillar specification 1E-b 38 is used to determine the multiplying factor for a given element percentage. This specification is found in the publication "Hardenability Prediction Calculation for Wrought Steels: by Caterpillar, Inc. incorporated herein by reference. If all of the elements were at their minimum or maximum values the corresponding multiplying factors would be as follows:

| | LOWEST VALUE | | HIGHEST VALUE | |
|---|---|---|---|---|
| | % | MF | % | MF |
| Carbon | .40 | .213 | .48 | .233 |
| Manganese | 1.35 | 5.765 | 1.61 | 7.091 |
| Chromium | 0 | 1.0 | .23 | 1.497 |
| Silicon | .16 | 1.112 | .30 | 1.21 |
| Molybdenum | 0 | 1. | .15 | 1.45 |
| Nickel | 0 | 1. | .20 | 1.073 |
| Copper | 0 | 1. | .15 | 1.06 |

If the multiplying factors for the lowest values of all elements are multiplied together the DI=1.3 inches which would be inadequate to meet the additionally imposed minimum DI of 2.1 inches. Likewise if all the highest percentage multiplying factors are multiplied together the DI would be 4.9 inches again beyond the maximum allowable DI of 2.6 inches.

Alternately or additionally, the hardenability can be specified in terms of a minimium hardness gradient, a maximum core hardness, a maximum hardness at a given depth, and a range of surface hardnesses. The requirements for a more than adequate strength and fatigue life would be a maximum core hardness of $R_c$ 35, a maximum hardness of $R_c$ 40 at a depth of 0.47 inches and a surface hardness range of $R_c$ 52 to $R_c$ 59. The maximum hardness gradient would be as follows:

| DISTANCE IN INCHES | Rc |
|---|---|
| .050" | 52 |
| .100" | 52 |
| .200" | 52 |
| .300" | 45 |
| .400" | 33 |
| .500" | 22 |

The foregoing hardenability specification takes into account the fact that the axle shaft is tempered after induction hardening at a temperature not to exceed 350° F. for from 1½ to 2 hours. An additional requirement to assure elimination of residual stresses by the tempering is that it be conducted within two hour of the induction hardening.

The embodiments of the invention in which an exclusive property or privilege is claimed are defined as follows:

1. An axle shaft with a rated capacity between 30,000 and 44,000 pounds and a body diameter between 1.70 and 2.05" having been made by forging and machining the ends thereof and induction hardening with no intermediate heat treating between forging and hardening, said composition consisting essentially of 0.40–0.48% carbon, 1.35–1.61% manganese, 0–0.23% silicon, 0–0.23% chromium, 0–0.15% copper, 0–0.20% nickel, 0–0.15% molybdenum, 0.020–0.45% sulfur, 0.025–0.050% aluminum and 0.035% maximum phosphorus, with the balance being iron, and said shaft having a critical diameter of 2.1–2.6".

2. An alloy composition for forming axle shafts with a body diameter between 1.70 and 2.05" by forging and machining the ends thereof and induction hardening with no intermediate heat treating between forging and hardening, said composition consisting essentially of 0.40–0.48% carbon, 1.35–1.61% manganese, 0–0.23% silicon, 0–0.23% chromium and the balance iron and other materials not affecting the hardenability of the steel said alloy having a critical diameter value of between 2.1 and 2.6" calculated by utilizing the multiplying factors for carbon, manganese, silicon and chromium.

3. The alloy steel composition according to claim 2 wherein said alloy steel further contains 0.025–0.05% aluminum.

4. The alloy steel composition according to claim 2 wherein said steel contains 0–0.15% copper, 0.020–0.20% nickel, 0–0.15% molybdenum, 0.020–0.045% sulfur and 0.035% maximum phosphorus and the critical diameter is calculated also utilizing the multiplying factors for copper nickel and molybdenum.

5. An axle shaft with a rated capacity between 30,000 and 44,000 pounds and a body diameter between 1.70 and 2.05" by forging and machining the ends thereof and induction hardening with no intermediate heat treating between forging and hardening, said composition consisting essentially of 0.40–0.48% carbon, 1.35–1.61% manganese, 0–0.23% silicon, 0–0.23% chromium and the balance iron and other materials not affecting the hardenability of the steel said alloy having a critical diameter value of between 2.1 and 2.6" calculated by utilizing the multiplying factors for carbon, manganese silicon and chromium.

* * * * *